US010490134B2

(12) United States Patent
Hwang

(10) Patent No.: US 10,490,134 B2
(45) Date of Patent: Nov. 26, 2019

(54) AREA-EFFICIENT APPARATUS AND METHOD FOR SENSING SIGNAL USING OVERLAP SAMPLING TIME

(71) Applicant: DB HiTek Co., Ltd., Seoul (KR)

(72) Inventor: Tae-Ho Hwang, Seoul (KR)

(73) Assignee: DB HiTek, Co., Ltd., Seoul (KR)

( * ) Notice: Subject to any disclaimer, the term of this patent is extended or adjusted under 35 U.S.C. 154(b) by 75 days.

(21) Appl. No.: 15/821,986

(22) Filed: Nov. 24, 2017

(65) Prior Publication Data

US 2019/0051251 A1 Feb. 14, 2019

(30) Foreign Application Priority Data

Aug. 9, 2017 (KR) ..... 10-2017-0101155

(51) Int. Cl.
*G09G 3/3283* (2016.01)
*G09G 3/32* (2016.01)
*G09G 3/3275* (2016.01)

(52) U.S. Cl.
CPC ... *G09G 3/3283* (2013.01); *G09G 2300/0452* (2013.01); *G09G 2300/0828* (2013.01); *G09G 2300/0852* (2013.01); *G09G 2310/027* (2013.01); *G09G 2310/0294* (2013.01); *G09G 2310/0297* (2013.01); *G09G 2320/0233* (2013.01); *G09G 2320/0666* (2013.01); *G09G 2320/0693* (2013.01)

(58) Field of Classification Search
CPC .. G09G 3/3233; G09G 3/3688; G09G 3/3291; G09G 3/3696; G09G 2320/045; G09G 2320/0295; G09G 2320/043; G09G 2320/0233; G09G 2310/0291; G09G 2310/0294; G09G 2310/0286; G09G 2310/27; G09G 2330/12; G09G 3/3283; G09G 2300/0828; G09G 2300/0852; G09G 2310/0297; G09G 2320/0693
See application file for complete search history.

(56) References Cited

U.S. PATENT DOCUMENTS

2014/0368415 A1* 12/2014 Kim ..... G09G 3/3233 345/77
2015/0179105 A1* 6/2015 Mizukoshi ..... G09G 3/3266 345/76

* cited by examiner

*Primary Examiner* — Xuemei Zheng
(74) *Attorney, Agent, or Firm* — Andrew D. Fortney; Central California IP Group, P.C.

(57) ABSTRACT

The present invention relates to an area-efficient apparatus and method for sensing a signal using overlap sampling time. In a preferred embodiment of the present invention, the sensing apparatus sensing a signal which detects degradation of a light-emitting device and transferring the signal to a compensating circuit comprises: M switching portions connected to sensing lines included in each group of M groups into which N sensing lines are divided, where N>M and N and M are natural numbers. The switching portion is characterized by alternatively connecting any one of N/M sensing lines to a sample-and-hold portion.

10 Claims, 5 Drawing Sheets

AREA-EFFICIENT APPARATUS AND METHOD FOR SENSING SIGNAL USING OVERLAP SAMPLING TIME

TECHNICAL FIELD

The present disclosure relates to a sensing circuit technique for a display device.

BACKGROUND

A. Bernanose at the Nancy-Université in France published an article on electroluminescence in organic materials in 1953 for the first time in the world. Yet, the electroluminescent organic materials were not suitable for use as a display element as yet due to excessively high threshold voltage. In the meantime, Dr. C. W. Tang succeeded in developing an Organic Light-Emitting Diode, hereinafter referred to as an OLED, having an efficiency of 1.5 lm/W by using organic thin film materials.

Since then, the OLED has been commercialized and in the spotlight as a next-generation display element for having several advantages, such as vivid color reproduction, high contrast ratio, fast response rate, and wide view angle.

The OLED may be driven by voltage or current. In the former case, change in luminance may increase due to a deviation in the current-voltage characteristic of the OLED. Hence, to avoid such problem, it is common to drive the OLED by current despite the low driving speed.

A driving circuit for driving the OLED by current comprises a driving Thin Film Transistor (TFT), which applies a driving current to the OLED.

Although it is desirable to design electrical characteristics, such as the mobility or the threshold voltage of the driving TFT and, to be uniform in all pixels, a deviation in luminance for each pixel, caused by non-uniformity in processing and change in the threshold voltage ($V_{TH}$) due to stress voltage, occurs.

To solve such problem, the inventor of the present invention has been continuously researching and developing while experiencing trial and error and finally completed the present invention.

SUMMARY OF THE INVENTION

Technical Problems

An object of the present invention is to sense a signal, such as mobility or the threshold voltage of a driving transistor or an organic light-emitting diode included in a light-emitting device.

Another object of the present invention is to reduce the area of a sensing apparatus.

Still another object of the present invention is to reduce the number of sample-and-hold portions.

Still another object of the present invention is to reduce sensing time taking for sensing the threshold voltage or mobility.

Technical Solutions

In order to achieve the above objects, according to a first aspect of the present invention, provided is an area-efficient sensing apparatus using overlap sampling time, sensing a signal comprising mobility or threshold voltage of a driving transistor applying a driving current to an organic light-emitting diode or the organic light-emitting diode, comprising: M switching portions connected to a sensing line included in each group of M groups into which N sensing lines are divided, where N>M and N and M are natural numbers; wherein the switching portion alternatively connects any one of N/M sensing lines to a sample-and-hold portion.

In a preferred embodiment, the area-efficient sensing apparatus further comprises M sample-and-hold portions connected to the M switching portions, respectively, and receiving a signal transferred from the sensing line.

In a preferred embodiment, the sample-and-hold portion comprises:

a sampling capacitor $C_S$ storing a signal input from the sensing line; and a sharing capacitor $C_{SH}$ receiving the signal stored in the sampling capacitor.

In a preferred embodiment, the sample-and-hold portion comprises:

a first high reference voltage $V_{REFAH}$;

a first low reference voltage $V_{REFAL}$;

a second reference voltage $V_{REFB}$;

a sampling capacitor $C_S$ connected to a first node N1 connected to the switching portion and the second reference voltage $V_{REFB}$;

a sharing capacitor $C_{SH}$ connected to the first node and the first low reference voltage $V_{REFAL}$; and a plurality of switching elements.

In a preferred embodiment, the plurality of switching elements comprises:

a first switch SW1 formed between the sampling capacitor $C_S$ and the second reference voltage $V_{REFB}$;

a second switch SW2 formed between the sampling capacitor $C_S$ and the first low reference voltage $V_{REFAL}$;

a third switch SW3 formed between the first node N1 and the sharing capacitor $C_{SH}$;

a fourth switch SW4 formed between the sharing capacitor $C_{SH}$ and the first low reference voltage $V_{REFAL}$; and a fifth switch SW5 formed between the sharing capacitor $C_{SH}$ and the first high reference voltage $V_{REFAH}$.

In a preferred embodiment, the area-efficient sensing apparatus further comprises:

a multiplexer connected to M sample-and-hold portions; and an analog-to-digital converting portion ADC connected to the multiplexer.

In a preferred embodiment, the analog-to-digital converting portion converts M signals stored in the sharing capacitor by being input through one sensing line of the N/M sensing lines into digital signals in sequence, and the sampling capacitor starts storing a signal input through another sensing line of the N/M sensing lines before the analog-to-digital converting portion completes digital signal conversion.

According to a second aspect of the present invention, provided is a sensing method using overlap sampling time for sensing a signal using a sensing apparatus comprising a switching portion alternatively selecting one of a plurality of sensing lines and transferring thereof to a sample-and-hold portion, the sample-and-hold portion connected to the switching portion, and an analog-to-digital converting portion converting a signal received from the sample-and-hold portion into a digital signal, comprising:

(a) a step in which the sample-and-hold portion stores a first signal input through a first sensing line of the plurality of sensing lines connected to the switching portion;

(b) a step in which the sample-and-hold portion shares the first signal;

(c) a step in which the analog-to-digital converting portion converts the shared first signal into a digital signal; and (d) a step in which the sample-and-hold portion starts storing a second signal input through a second sensing line of the plurality of sensing lines connected to the switching portion prior to the completion of step (c).

In a preferred embodiment, the area-efficient sensing method further comprises:

a step in which the switching portion connects the first sensing line to the sample-and-hold portion prior to step (a); and a step in which the switching portion connects a next sensing line to the sample-and-hold portion prior to step (d).

In a preferred embodiment, the area-efficient sensing method further comprises:

a step in which the sample-and-hold portion shares the second signal after step (d); and a step in which the analog-to-digital converting portion converts the second signal shared in the sample-and-hold portion into a digital signal.

According to a third aspect of the present invention, provided is an area-efficient sensing method for sensing a signal using a sensing apparatus comprising M switching portions connecting a plurality of sensing lines included in each group of M groups into which N sensing lines are divided to sample-and-hold portions in sequence, M sample-and-hold portions including a sampling capacitor $C_S$ storing a signal input from the sensing line and a sharing capacitor $C_{SH}$ receiving the signal stored in the sampling capacitor, and an analog-to-digital converting portion converting an analog signal into a digital signal, comprising:

(a) a step in which the sampling capacitor stores a first signal input through a first sensing line of N/M sensing lines;

(b) a step in which the sharing capacitor is shared with the first signal;

(c) a step in which the analog-to-digital converting portion converts the first signal stored in the sharing capacitor into a digital signal; and (d) a step in which the sampling capacitor starts storing a second signal input through a second sensing line of the N/M sensing lines prior to the completion of step (c).

In a preferred embodiment, the area-efficient sensing method further comprises:

a step in which the switching portion connects the first sensing line to the sample-and-hold portion prior to step (a); and a step in which the switching portion connects a next sensing line to the sample-and-hold portion prior to step (d).

In a preferred embodiment, the area-efficient sensing method further comprises:

a step in which the sharing capacitor receives the second signal after step (d); and a step in which the analog-to-digital converting portion converts the second signal charged in the sharing capacitor into a digital signal after the completion of step (c).

Technical Effects

The present disclosure can obtain the following effects by the technical solutions described above.

According to the present invention, the mobility or the threshold voltage of a driving driver or an organic light-emitting diode included in a light-emitting device can be sensed.

In addition, according to the present invention, the number of sample-and-hold portions can be reduced. Also, according to the present invention, sensing time for sensing the threshold voltage or mobility can be reduced.

The effects described in the description and provisional effects thereof which are expected from the technical features of the present invention are regarded as being disclosed in the present disclosure even if not explicitly stated herein.

The accompanying drawings are included to provide a further understanding of the technical concepts of the present disclosure, and the scope of the present invention is not limited thereto.

DESCRIPTION OF EMBODIMENTS/DETAILED DESCRIPTION

Descriptions related to well-known functions or configurations obvious to those skilled in the art will not be provided in detail in case they may unnecessarily obscure the understanding of the present invention.

Figure 1:
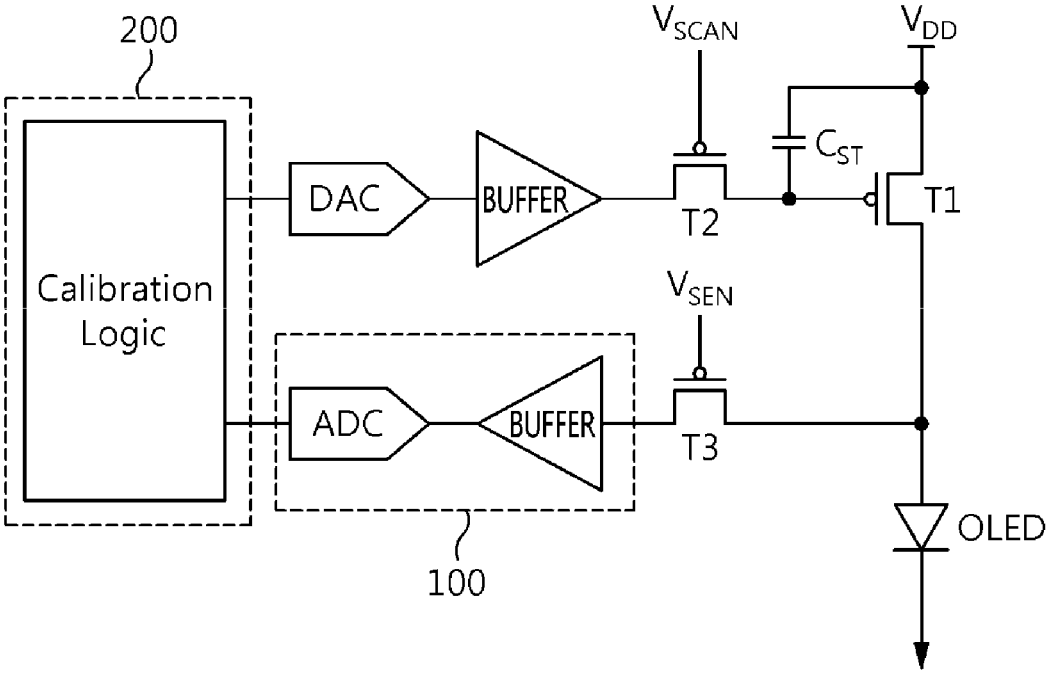
FIG. 1 is a view illustrating a schematic embodiment of an organic light-emitting device.

FIG. 1 is a view illustrating a schematic embodiment of an organic light-emitting device. Although not shown in the drawings, pixels comprising organic light-emitting diodes (OLEDs) are arranged in a shape of matrix in a display panel of the organic light-emitting device. Each pixel generates light having a luminance corresponding to a magnitude of a data signal supplied from a data line when a gate signal (a scan signal) is provided to a gate line (a scan line). The OLEDs showing unique colors are disposed in unit pixels of the display panel, respectively, and a color combination thereof enables a targeted color to be displayed.

The OLEDs have advantages of fast response rates, high light-emitting efficiency, high luminance, and wide view angles. Being a self-luminous element, the OLED comprises an anode electrode and a cathode electrode, and organic compound layers (HIL, HTL, EML, ETL, EIL) formed between the anode electrode and the cathode electrode. The organic compound layers include a Hole Injection Layer (HIL), a Hole Transport Layer (HTL), an Emission Layer (EML), an Electron Transport Layer (ETL), and an Electron Injection Layer (EIL). When a driving voltage is applied to the anode electrode and the cathode electrode, a hole passing through the Hole Transport Layer (HTL) and an electron passing through the Electron Transport Layer (ETL) move to the Emission Layer (EML) and form an exciton. As a result, the Emission Layer (EML) creates visible light.

As can be understood from FIG. 1, a driving circuit is required to operate the OLEDs. The driving circuit may comprise various embodiments, one of which is exemplified in FIG. 1, illustrating the simplest structure, a 2T1C structure. 2T denotes two transistors, and 1C denotes one capacitor being used. The transistor may be a Thin Film Transistor.

A driving transistor T1 drives the organic light-emitting diode (OLED). A switching transistor T2 functions as a switch for inputting applied driving voltage through the data line to a gate terminal of the driving transistor T1. A storage capacitor $C_{ST}$ maintains the voltage of the gate terminal of the driving transistor T1 for one frame time. $V_{DD}$ is power for supplying current to the OLED through the driving transistor T1. $V_{SCAN}$ is a gate voltage applied through the gate line.

Having to continuously drive the OLED for one frame time, the driving transistor T1 is subject to continuous stress. Consequently, the driving transistor T1 is degraded, which causes the threshold voltage to increase. Also, minute differences in processing conditions cause variations in each electrical characteristic of the driving transistor T1 and, thus, the threshold voltages become different with each other.

In the same manner, the OLEDs are degraded as time passes.

Accordingly, the light-emitting device using a plurality of OLEDs requires a sensing device 100, capable of sensing difference or change in the mobility or the threshold voltages of the driving transistor or the organic light-emitting element, and a compensating device 200 which compensates the threshold voltage or the like based on the sensing result.

In a preferred embodiment, the sensing device 100 comprises a buffer unit and an analog-to-digital converting unit. The compensating device 200 comprises a calibration logic. The compensating device 200 may be connected to a driving device comprising a digital-to-analog converting unit and a buffer unit.

A sensing transistor T3 transfers a signal measured in the relevant pixel to the sensing device 100 through a sensing line when a sensing voltage $V_{SEN}$ is applied to the gate terminal. In the present disclosure, the signal (or an analog signal) transferred to the sensing device 100 is a concept which encompasses the mobility and the threshold voltage of the organic light-emitting element or the driving transistor.

Figure 2:
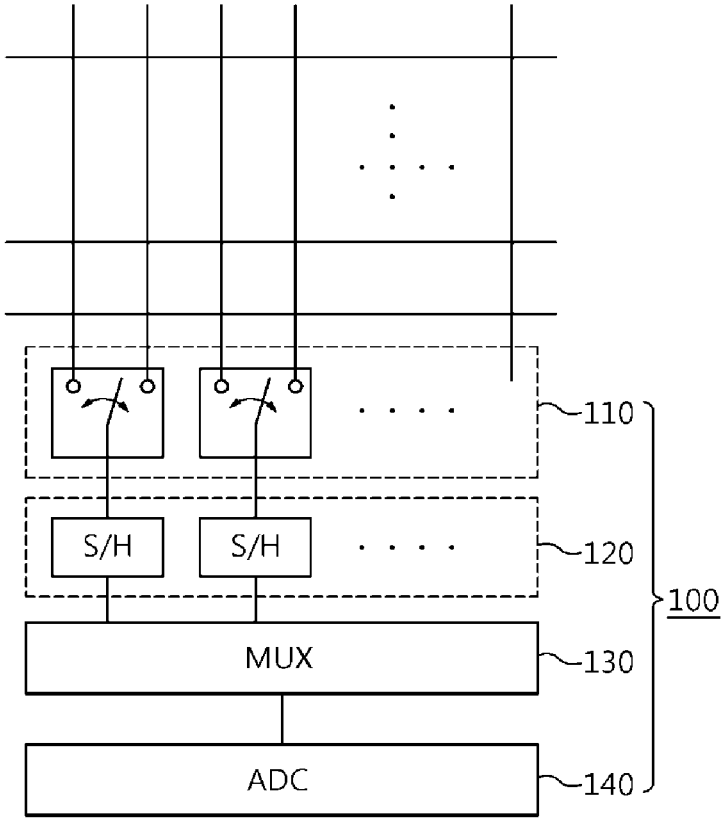
FIG. 2 is a view illustrating a preferred embodiment of a sensing apparatus according to the present invention.

FIG. 2 is a view illustrating a preferred embodiment of the sensing device according to the present invention.

As can be understood from FIG. 2, the sensing device 100 according to the present invention senses a signal, such as the mobility or the threshold voltage of the organic light-emitting diode or the driving transistor applying a driving current to the organic light-emitting diode and transfers the signal to a compensating circuit. In the preferred embodiment, the sensing device 100 comprises a switching portion 110, a sample-and-hold portion 120, a multiplexer 130, and an analog-to-digital converting portion 140. Although not shown in the drawings, an amplifier which amplifies a signal may be included between the multiplexer 130 and the analog-to-digital converting portion 140.

The switching portion 110 divides N sensing lines into M groups (N>M where N and M are natural numbers), and any one of N/M sensing lines included in each group is alternatively connected to the sample-and-hold portion 120. For instance, if 1280 sensing lines are to be divided into 640 groups, 640 switching portions 110 are required and each switching portion 110 is configured to alternatively connect two sensing lines. Hereinafter a term "channel" may be used to represent the number (N/M) of the sensing lines which the switching portion 110 may alternatively select. In other words, "a plurality of channels" connected to the switching portion may be used as the same meaning as "a plurality of sensing lines." In the above embodiment, if 1280 sensing lines are connected to 640 switching portions 110, each switching portion 110 has two channels, while each switching portion 110 has four channels if 1280 sensing lines are connected to 320 switching portions 110.

The sample-and-hold portion 120 is connected one-on-one to the switching portion 110. The sample-and-hold portion 120 receives a signal transferred from a channel selected by the switching portion 110. Accordingly, if there exist M switching portions 110, M sample-and-hold portions 120 are required. The multiplexer 130 is connected to the M sample-and-hold portions 120 and successively transfers signals input by the M sample-and-hold portions 120 to the analog-to-digital converting portion 140.

When the N sensing lines are divided into the M groups as above, the number of switching portions decreases from N to M, and the number of sample-and-hold portions decreases from N to M as well. Moreover, a small area multiplexer can be used since the multiplexer needs to process M:1 signal, not N:1.

Consequently, if N sensing lines are grouped into M groups, the number of switching portions, the number of sample-and-hold portions, and the area of the multiplexer can be reduced, thereby creating a sensing device with a small area. Previously, the sample-and-hold portion, in particular, took up a large space as it uses a capacitor, which was disadvantageous. However, since the number of sample-and-hold portions drastically decreases in the aforementioned structure, a sensing device with a small area can be advantageously produced.

The analog-to-digital converting portion 140 converts an analog signal input by the multiplexer 130 to a digital signal. The converted digital signal is stored in a certain memory.

Below it is described in detail that an input signal from which sensing line is converted into a digital signal in the analog-to-digital converting portion 140.

First, the sample-and-hold portion 120 stores a signal input through one sensing line, selected from the N/M sensing lines connected to the switching portion 110. The multiplexer 130 transfers the signals stored in the M sample-and-hold portions 120 to the analog-to-digital converting portion 140 in sequence. The analog-to-digital converting portion 140 stores the signals as digital signals in sequence.

Figure 3:
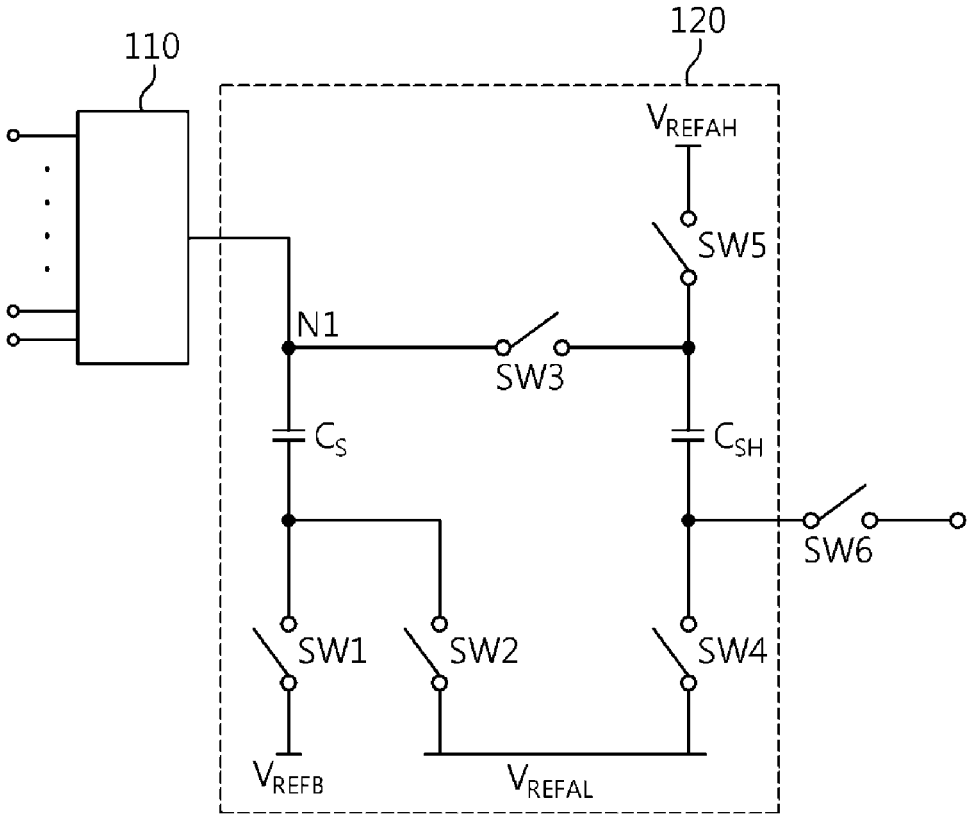
FIG. 3 is a view illustrating a preferred embodiment of a sample-and-hold portion according to the present invention.

FIG. 3 is a view illustrating a preferred embodiment of the sample-and-hold portion according to the present invention.

As can be understood from FIG. 3, the sample-and-hold portion 120 comprises a sampling capacitor $C_S$ storing a signal input from the sensing line and a sharing capacitor $C_{SH}$ receiving the signal charged in the sampling capacitor in the preferred embodiment.

The signal input from the switching portion 110 is stored in the sampling capacitor $C_S$. The signal stored in the sampling capacitor $C_S$ is scaled down as being transferred to the sharing capacitor $C_{SH}$. The signal stored in the sharing capacitor $C_{SH}$ is transferred to the analog-to-digital converting portion in sequence by the multiplexer.

At this time, the sampling capacitor $C_S$ starts storing a signal input through another sensing line of the N/M sensing lines before the analog-to-digital converting portion completes digital signal conversion, thereby reducing conversion time.

The embodiment of the sample-and-hold portion set forth in FIG. 3 is described in detail as follows.

The switching portion 110 is connected to a first node N1 of the sample-and-hold portion 120. The sample-and-hold portion 120 comprises a first high reference voltage $V_{REFAH}$, a first low reference voltage $V_{REFAL}$, and a second reference voltage $V_{REFB}$. The sampling capacitor Cs is connected to the first node N1 and the second reference voltage $V_{REFB}$. A first switch SW1 is present between the sampling capacitor $C_S$ and the second reference voltage $V_{REFB}$. A second switch SW2 is present between the sampling capacitor $C_S$ and the first low reference voltage $V_{REFAL}$. The sharing capacitor $C_{SH}$ is connected to the first node N1 and the first low reference voltage $V_{REFAL}$. A third switch SW3 is present between the first node N1 and the sharing capacitor $C_{SH}$. A fourth switch SW4 is present between the sharing capacitor $C_{SH}$ and the first low reference voltage $V_{REFAL}$. A fifth switch SW5 is present between the sharing capacitor $C_{SH}$ and the first high reference voltage $V_{REFAH}$. A sixth switch SW6 is a switch included in the multiplexer. The multiplexer includes M-number of the sixth switches SW6 connected to the sample-and-hold portions.

In the preferred embodiment, if the first switch SW1 is turned on, difference between the voltage applied to the first node N1 and the second reference voltage $V_{REFB}$ is stored in the sampling capacitor $C_S$. The sampling capacitor $C_S$ is connected to the sharing capacitor $C_{SH}$ in parallel by turning off the first switch SW1 and turning on the second to fourth switches SW2, SW3, SW4. Then the voltage charged in the sampling capacitor $C_S$ is shared to the sharing capacitor $C_{SH}$. The sharing capacitor $C_{SH}$ is connected to the first high reference voltage $V_{REFAH}$ by turning off the second to fourth switches SW2, SW3, SW4 and turning on the fifth switch SW5.

The multiplexer connects the M switches to the analog-to-digital converting portion in sequence. The analog-to-digital converting portion converts into digital values in sequence the signals shared to the sharing capacitor $C_{SH}$ connected by the multiplexer.

The second reference voltage $V_{REFB}$ is a higher voltage than the voltage used in the first high reference voltage $V_{REFAH}$ and the first low reference voltage $V_{REFAL}$.

Figure 4:
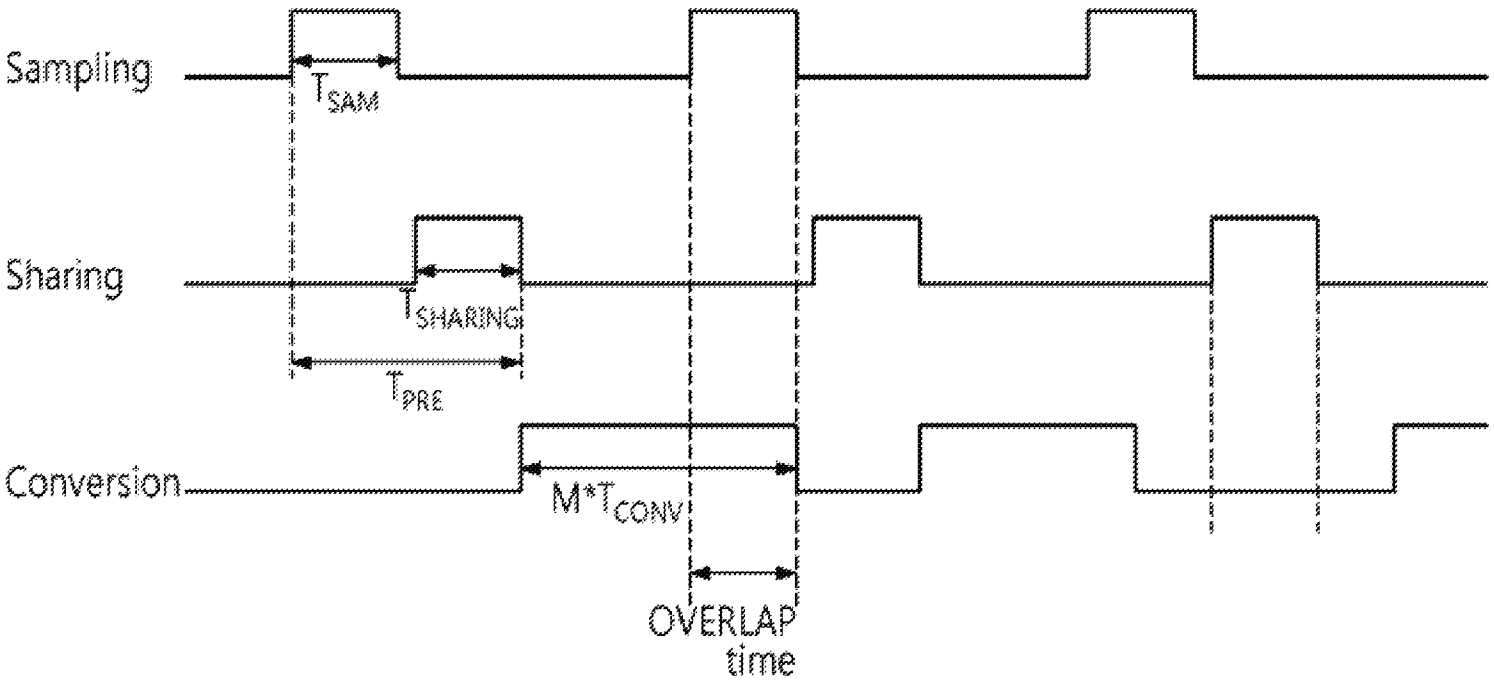
FIG. 4 is a view illustrating a preferred embodiment of sampling threshold voltages.

FIG. 4 illustrates a preferred embodiment of sampling signals according to the present invention. In FIG. 4, the first timing diagram indicates time for storing a signal in the sampling capacitor, the second timing diagram indicates time for sharing the signal in the sharing capacitor, and the third timing diagram indicates time for converting the analog signal stored in the sharing capacitor into the digital signal by the analog-to-digital converting portion.

(1) Conversion on a First Channel

First, each of M switching portions selects one channel of a plurality of channels connected to itself. The M switching portions connect the selected channels to M sample-and-hold portions, respectively.

The sampling capacitor included in the sample-and-hold portion stores an input analog signal ($T_{SAM}$). The sharing capacitor scales down the analog signal stored in the sampling capacitor and receives the scaled down analog signal ($T_{SHARING}$). In each of the M sample-and-hold portions included are the sampling capacitor and the sharing capacitor. Accordingly, the M sample-and-hold portions can simultaneously store in the capacitors the analog signals supplied from the channels connected thereto. Therefore, the time taking for the sampling capacitors of the M sample-and-hold portions to store the analog signals is not $M*T_{SAM}$ but $T_{SAM}$.

The multiplexer connects the M sample-and-hold portions to the analog-to-digital converting portion in sequence. The analog-to-digital converting portion converts the scaled-down, input analog signals into digital signals in the sampling capacitor ($M*T_{CONV}$).

Since the analog-to-digital converting portion converts the analog signals stored in the M sampling capacitors in sequence, the time for converting M signals is $M*T_{CONV}$.

(2) Conversion of a Next Channel

Next, each of the M switching portions selects a next channel of the plurality of channels connected thereto. The M switching portions connect the selected channels to the M sample-and-hold portions, respectively. The M sample-and-hold portions store analog signals. The multiplexer connects the M sample-and-hold portions to the analog-to-digital converting portion in sequence. The analog-to-digital converting portion converts the connected signals in sequence.

(3) Repetition of the Above Operation and Securing Overlap Time

According to the present invention, conversion of analog signals with respect to every channel is implemented by repeating steps (1) and (2) above.

According to the present invention, time taking for sensing analog signals are reduced by securing overlap time between repetition of each step. Specifically, the sampling capacitor starts to store an analog signal input through another sensing line in advance to reduce conversion time before the analog-to-digital converting portion completes the conversion of digital signal (OVERLAP time).

This is described with a more specific example as follows.

Assuming that N=1280 and M=640, each of the M switching portions is allowed to have two channels. That is, if sampling/sharing/conversion is repeated twice overall, all analog signals of the sensing lines can be sensed.

If the time for sensing the analog signals of all sensing lines is assumed to be $T_{TSEN}$, $T_{TSEN}$ can be defined as follows.

$$T_{TSEN}=N/M*(T_{SAM}+T_{SHARING}+M*T_{CONV})=2*(T_{SAM}+T_{SHARING}+640*T_{CONV})$$

Yet according to the present invention, overall conversion time is reduced by staring a step in which an analog signal of a next channel is stored in the sampling capacitor before the time ($M*T_{CONV}$) for converting an analog signal of a certain channel ends.

In this case, the time which can be reduced is the overlap time (OVERLAP time). If the time for sensing the analog signals of all sensing lines is assumed to be $T_{TSEN_OV}$, when the overlap time is applied, $T_{TSEN_OV}$ may be defined as follows.

$$T_{TSEN_OV}=T_{SAM}N/M*T_{SHARING}+M*T_{CONV})=T_{SAM}+2*(T_{SHARING}+640*T_{CONV})$$

When the overlap time is $T_{SAM}$, $T_{TSEN_OV}$ is reduced by $T_{SAM}$. Accordingly, the total reduced time $T_{TOT}$ increases with increasing N/M.

$$\text{Total reduced time}(T_{TOT}) = T_{TSEN} - T_{TSEN_OV} = T_{SAM} * (N/M - 1)$$

Figure 5:
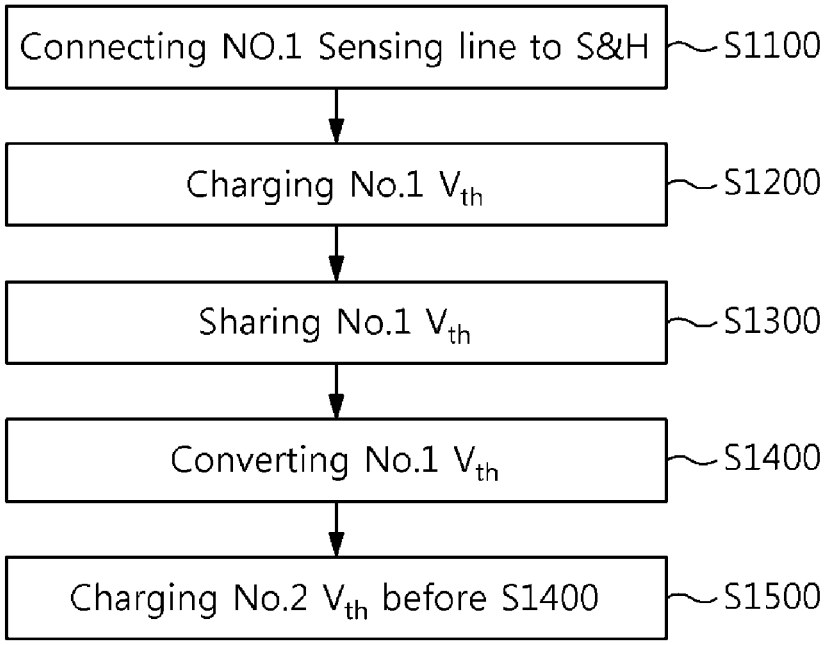
FIG. 5 is a view illustrating a preferred embodiment of a sensing method according to the present invention.

FIG. 5 is a flowchart illustrating a preferred embodiment of a sensing method according to the present invention. According to the sensing method of the present invention, N sensing lines are divided into M groups and analog signals are sensed using a sensing device, comprising M switching portions which connect a plurality of sensing lines included in each group to sample-and-hold portions in sequence, M sample-and-hold portions including a sampling capacitor $C_S$ which stores the analog signal input from the sensing line and a sharing capacitor $C_{SH}$ which receives the analog signal charged in the sampling capacitor, and an analog-to-digital converting portion which converts the analog signal into a digital signal.

First, the switching portion connects a first sensing line of the N/M sensing lines to the sample-and-hold portion (S1100). The sampling capacitor stores a first signal input through the first sensing line of the N/M sensing lines (S1200). The sharing capacitor is shared with the first signal (S1300). The analog-to-digital converting portion converts the first signal charged in the sharing capacitor into a digital signal (S1400).

The switching portion connects a next sensing line of the N/M sensing lines to the sample-and-hold portion prior to the completion of S1400, and the sampling capacitor starts to store a second signal input through the next sensing line (S1500).

The sharing capacitor receives the second signal. The analog-to-digital converting portion converts the second signal charged in the sharing capacitor into a digital signal.

The scope of the protection of the present invention is not limited to the above embodiments and expressions explicitly described. Moreover, it should be noted that the scope of the protection of the present invention cannot be limited due to modifications and replacements that are obvious in the technical field within the present invention falls.

What is claimed is:

1. An area-efficient sensing apparatus using overlap sampling time, sensing a signal comprising mobility or threshold voltage of a driving transistor applying a driving current to an organic light-emitting diode, comprising:

M switching portions each connected to a sensing line included in a respective group of M groups of sensing lines into which N sensing lines are divided, where N>M and N and M are natural numbers;

M sample-and-hold portions connected to the M switching portions, respectively, and each receiving a signal transferred from any one of N/M sensing lines included in the respective group of M groups of sensing lines;

a multiplexer connected to the M sample-and-hold portions; and an analog-to-digital converting portion ADC connected to the multiplexer, wherein each of the M switching portions alternatively connects any one of N/M sensing lines included in the respective group of M groups of sensing lines to the respective M sample-and-hold portions, each of the M sample-and-hold portions comprises (i) a sampling capacitor $C_S$ storing a signal input from the sensing line and (ii) a sharing capacitor $C_{SH}$ receiving the signal stored in the sampling capacitor, the analog-to-digital converting portion converts M signals each stored in the respective sharing capacitors by being input through one sensing line of the N/M sensing lines included in the respective group of M groups of sensing lines into digital signals in sequence, and each of the sampling capacitors starts storing a signal input through another sensing line of the N/M sensing lines included in the respective group of M groups of sensing lines before the analog-to-digital converting portion completes digital signal conversion.

2. The area-efficient sensing apparatus of claim 1, wherein each of the M sample-and-hold portions comprises:

a first low reference voltage $V_{REFAL}$;

a second reference voltage $V_{REFB}$;

the sampling capacitor $C_s$ connected to a first node N1 connected to each of the M switching portions and the second reference voltage $V_{REFB}$;

the sharing capacitor $C_{SH}$ connected to the first node and the first low reference voltage $V_{REFAL}$; and a plurality of switching elements.

3. The area-efficient sensing apparatus of claim 2, wherein each of the plurality of switching elements comprises:

a first switch SW1 formed between the sampling capacitor $C_s$ and the second reference voltage $V_{REFB}$;

a second switch SW2 formed between the sampling capacitor $C_s$ and the first low reference voltage $V_{REFAL}$;

a third switch SW3 formed between the first node N1 and the sharing capacitor $C_{SH}$;

a fourth switch SW4 formed between the sharing capacitor $C_{SH}$ and the first low reference voltage $V_{REFAL}$; and a fifth switch SW5 formed between the sharing capacitor $C_{SH}$ and the first high reference voltage $V_{REFAH}$.

4. The area-efficient sensing apparatus of claim 1, wherein a point of time when each of the sampling capacitors completes storing the signal input through another sensing line of the N/M sensing lines included in the respective group of M groups of sensing lines coincides approximately with a point of time when the analog-to-digital converting portion completes converting the analog signals through the one sensing line of the N/M sensing lines included in the respective group of M groups of sensing lines into the digital signals.

5. An area-efficient sensing method using overlap sampling time for sensing a signal using a sensing apparatus comprising a switching portion alternatively selecting one of a plurality of sensing lines and transferring thereof to a sample-and-hold portion, the sample-and-hold portion connected to the switching portion, and an analog-to-digital converting portion converting a signal received from the sample-and-hold portion into a digital signal, comprising:

(a) a step in which the sample-and-hold portion stores a first signal input through a first sensing line of the plurality of sensing lines connected to the switching portion;

(b) a step in which the sample-and-hold portion shares the first signal;

(c) a step in which the analog-to-digital converting portion converts the shared first signal into a digital signal; and (d) a step in which the sample-and-hold portion starts storing a second signal input through a second sensing line of the plurality of sensing lines connected to the switching portion prior to the completion of step (c).

6. The area-efficient sensing method of claim 5, further comprising:

a step in which the switching portion connects the first sensing line to the sample-and-hold portion prior to step (a); and a step in which the switching portion connects a next sensing line to the sample-and-hold portion prior to step (d).

7. The area-efficient sensing method of claim 5, further comprising:

a step in which the sample-and-hold portion shares the second signal after step (d); and a step in which the analog-to-digital converting portion converts the second signal shared in the sample-and-hold portion into a digital signal.

8. An area-efficient sensing method for sensing a signal using a sensing apparatus comprising M switching portions, each connected to a sensing line included in a respective group of M groups of sensing lines into which N sensing lines are divided, where N>M and N and M are natural numbers, M sample-and-hold portions connected to the M switching portions, respectively, each receiving a signal transferred from any one of N/M sensing lines included in the respective group of M groups of sensing lines, and each including a sampling capacitor $C_S$ storing a signal input from the sensing line and a sharing capacitor $C_{SH}$ receiving the signal stored in the sampling capacitor, and an analog-to-digital converting portion converting an analog signal into a digital signal, comprising:

(a) a step in which each of the sampling capacitors stores a first signal input through a first sensing line of N/M sensing lines included in the respective group of M groups of sensing lines;

(b) a step in which each of the sharing capacitors is shared with the respective first signal;

(c) a step in which the analog-to-digital converting portion converts the first signals each stored in the respective sharing capacitors, into digital signals; and (d) a step in which each of the sampling capacitors starts storing a second signal input through a second sensing line of the N/M sensing lines included in the respective group of M groups of sensing lines prior to the completion of step (c).

9. The area-efficient sensing method of claim 8, further comprising:

a step in which each of the M switching portions connects the first sensing line to the respective sample-and-hold portions prior to step (a); and a step in which each of the M switching portions connects a next sensing line included in the respective group of M groups of sensing lines to the M sample-and-hold portions, respectively, prior to step (d).

10. The area-efficient sensing method of claim 8, further comprising:

a step in which each of the sharing capacitors receives the respective second signals after step (d); and a step in which the analog-to-digital converting portion converts the second signals charged in the respective sharing capacitors into digital signals after the completion of step (c).

* * * * *